United States Patent [19]

Perucchi

[11] 4,348,752

[45] Sep. 7, 1982

[54] ELECTRONIC WATCH WITH MOVABLE DETECTING MEMBER

[75] Inventor: Norberto Perucchi, St. Blaise, Switzerland

[73] Assignee: Eta A.G. Ebauches-Fabrik, Grenchen, Switzerland

[21] Appl. No.: 158,204

[22] Filed: Jun. 10, 1980

[30] Foreign Application Priority Data

Jun. 28, 1979 [CH] Switzerland ..... 6047/79

[51] Int. Cl.[3] ..... G04C 9/00

[52] U.S. Cl. ..... 368/187; 368/76; 368/157

[58] Field of Search ..... 368/69, 76, 80, 155, 368/156, 157, 160, 187, 188

[56] References Cited

U.S. PATENT DOCUMENTS 3,553,957 1/1971 Dome et al. ..... 368/187
3,855,781 12/1974 Chihara et al. ..... 368/28
4,091,612 5/1978 Meisner et al. ..... 368/187
4,196,584 4/1980 Oda ..... 368/187
4,209,976 7/1980 Flumm ..... 368/187

FOREIGN PATENT DOCUMENTS 2027953 2/1980 United Kingdom ..... 368/187

*Primary Examiner*—Bernard Roskoski
*Attorney, Agent, or Firm*—Stevens, Davis, Miller & Mosher

[57] ABSTRACT

The watch comprises a detecting device including a resilient blade, the free end of which cooperates with a disk. When a slot in the edge of the disk is oriented in the direction of the blade, the latter vibrates owing to its own resiliency. The two edges of the slot are preferably bent in opposite directions in order to increase the bending stress on the blade just before its abrupt release into the slot. A piezoelectric strip fixed to the blade registers voltage fluctuations, the polarity of which corresponds to the direction in which the blade moves.

3 Claims, 2 Drawing Figures

ELECTRONIC WATCH WITH MOVABLE DETECTING MEMBER

BACKGROUND OF THE INVENTION

1. Field of the Invention

This invention relates to electronic watches, and more particularly to an electronic watch of the type having hands, a gear train driving the hands, and a stepping motor driving the gear train, the gear train including a counter wheel provided with position-indicating means cooperating with a movable detecting member connected to a detection circuit and to a counter, the detecting member being capable of causing the transmission of signals in the detection circuit when the counter wheel rotates.

2. Description of the Prior Art

Electronic watches of this type have already been proposed. Thus, for example, in U.S. Pat. No. 3,855,781, the movable detecting member is intended to detect the rotation of the gear train whenever a pulse is supplied to the motor. The position-indicating means consist here of peripheral teeth on the counter wheel, these teeth cooperating with a jumper-type element fixed to the end of the detecting member. Furthermore, U.S. Pat. No. 3,553,957 likewise describes an electronic timepiece equipped with a detecting device. In this case, however, the design of the device involves electric contacts between a movable disk and fixed electrodes, so that the reliability of the device is not ensured. Its functions are only randomly performed. Because of the lack of reliability of prior art rotation detectors, their practical application in commercially available watches has not yet been possible on a large scale.

Yet development studies in connection with electronic watches having displays with hands has led the manufacturers of such watches to provide them with increasingly sophisticated functions, and it appears that the inclusion of a rotation detector in the gear train of such an electronic watch is likely to furnish the prerequisites for a great many highly diversified and very interesting applications which considerably broaden the range of possibilities for adding new functions to watches. Thus, the use of a movable detector of gear-train rotation is useful not only for automatically making up steps accidentally lost by the motor, for example, but also for performing certain setting functions, or data-storage functions in a memory circuit, or still other functions.

SUMMARY OF THE INVENTION

Thus, it is an object of this invention to provide an improved electronic watch having hands, comprising detection means which are both highly reliable and as compact as possible.

To this end, in the electronic watch according to the present invention, the position-indicating means include at least one projecting element capable of displacing the detecting member differently according to the direction of rotation of the counter wheel, so that the signals transmitted make it possible to count algebraically the number of revolutions effected by the counter wheel.

BRIEF DESCRIPTION OF THE DRAWINGS

A preferred embodiment of the invention will now be described in detail with reference to the accompanying drawings, in which.

DETAILED DESCRIPTION OF THE INVENTION

Figure 1:
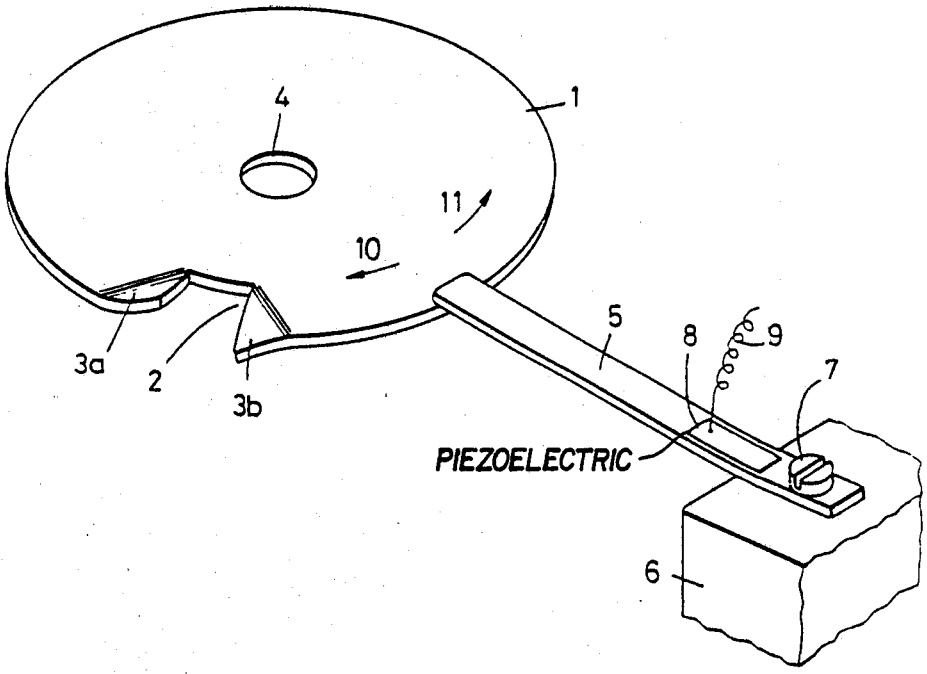
FIG. 1 is a simplified, diagrammatical perspective view of the detecting device of the watch.

The mechanical part of the detector is illustrated in FIG. 1, which shows a round disk 1 having a shallow radial slot 2 of uniform width from the bottom thereof to the periphery of disk 1. The side edges of slot 2 are slightly bent, edge 3*a* being bent upward and edge 3*b* downward. Edges 3*a* and 3*b* are also shown on a larger scale in FIG. 2. Disk 1 will be fitted on the arbor of a gear in the gear train. For this purpose, it is blanked with a center hole 4, although it will be understood that any other type of fitting might equally well be used. The disk 1 illustrated in FIG. 1 is a thin plate, which may be of metal. It would also be possible to provide, for example, a somewhat thicker plate having the edges of slot 2 cut at an angle.

The speed of rotation of disk 1 is not a critical characteristic of the device being described. This means that, as the case may be, disk 1 could be mounted, for instance, on the fourth wheel, on the center wheel, or on an intermediate wheel between the fourth wheel and the center wheel. Furthermore, although the drawing shows a disk 1 having only one radial slot 2, it should be understood that a disk provided with a number of slots 2 regularly distributed along its periphery, as shown in dot-dash lines in FIG. 1, can likewise operate under exactly the same conditions as are to be described below.

The mechanical components of the detector further include a metal detecting blade 5, of beryllium bronze, for example, capable of bending resiliently. Blade 5 will be fixed to a frame element of the watch movement, e.g., to a stud 6, from which it extends radially toward the axis of hole 4. In the embodiment illustrated schemetically in FIG. 1, blade 5 is fixed to stud 6 by means of a screw 7, although any other more elaborate type of fastening may be found suitable as well. It will be seen that the length of blade 5 is such that the free end thereof, situated nearest disk 1, extends slightly over the edge of this disk. A piezoelectric strip 8, e.g., a thin strip of quartz, is fixed, by cementing, for instance, to one of the faces of blade 5. Blade 5 itself is electrically connected to the frame of the movement by means not shown in FIG. 1. The upper face of strip 8 is connected by a wire 9 to a circuit for processing detection signals, to be described below. It will be understood that if blade 5 bends relative to its rest position, e.g., upward, a voltage of a certain polarity, e.g., positive, will appear in wire 9; whereas if blade 5 bends downward, the voltage appearing in wire 9 will be of the opposite polarity, e.g., negative. At the time of assembly, blade 5 will be oriented and positioned in such a way as to be situated exactly in the plane of disk 1, so that when the end of blade 5 rests on the upper surface of disk 1, as in FIG. 1, piezoelectric strip 8 is arched slightly upward. As a result, a slight voltage, e.g., positive, appears in connection 9 and is maintained as long as blade 5 remains in the position relative to disk 1 shown in FIG. 1.

Figure 2:
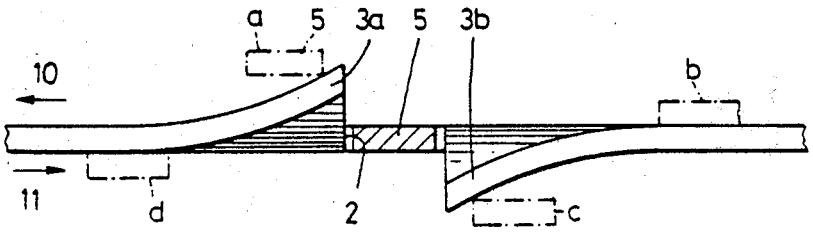
FIG. 2 is a partial side elevation, on a larger scale, of an element of the detector shown in FIG. 1.

FIG. 2 shows how the end of blade 5 cooperates with disk 1, and particularly with bent edges 3*a* and 3*b*, when disk 1 rotates. Assuming rotation in the direction of arrow 10, appearing in both FIG. 1 and FIG. 2, all points along the periphery of disk 1 successively pass beneath the end of blade 5. When disk 1 has almost effected a complete revolution, raised edge 3*a* reaches the end of blade 5, which is thus pushed up into the position designated as a in FIG. 2. Disk 1 continues rotating in the direction of arrow 10, so that raised edge 3*a* passes under the end of blade 5 and reaches a position in which blade 5 is released into slot 2. Owing to its resiliency, blade 5 then drops and tends to assume a median position which it reaches after several vibrations. If disk 1 continues to rotate in the same direction, blade 5 resumes contact with disk 1, but this time with the upper surface of bent edge 3*b*. When disk 1 has completed its revolution, blade 5 is once more in the position designated as b in FIG. 2, which is the same as the position of blade 5 in FIG. 1.

Supposing now that disk 1 rotates in the opposite direction, i.e., as indicated by arrow 11 in FIGS. 1 and 2, the end of blade 5, starting from position b, slides along the upper surface of disk 1 and particularly of downwardly-bent edge 3*b*. It reaches the median position shown in solid lines in FIG. 2, then comes in contact with the underside of edge 3*a*. Finally, it reaches the relative position designated as d in FIG. 2. Thereafter, if disk 1 continues to rotate in the direction of arrow 11, the end of blade 5 follows the periphery of disk 1 along the underside thereof and finally reaches the position designated as c in FIG. 2, where it is pushed downward by bent edge 3*b*. As soon as blade 5 is aligned with slot 2, it is abruptly released and vibrates until it is again in its median position.

Figure 3:
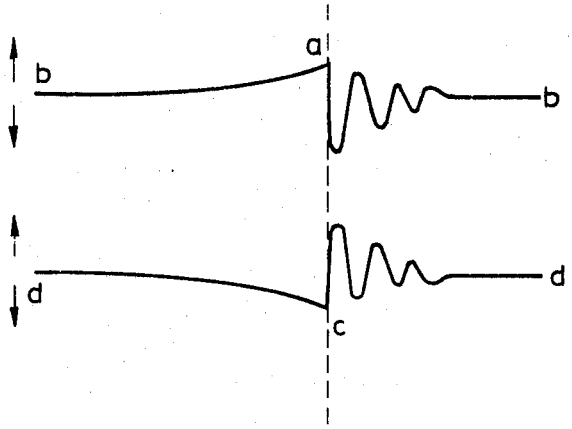
FIG. 3 is a graph showing the detection signals in two different cases of operation of the detector of FIG. 1.

It will be realized that each time quartz strip 8 is bent, a voltage is produced in wire 9. The curve of voltages thus produced in each of the directions of rotation just described is shown in FIG. 3. The upper curve of FIG. 3 corresponds to the displacement b-a-b of blade 5 relative to the different portions of disk 1, while the lower curve corresponds to the displacement d-c-d, i.e., when blade 5 has passed under disk 1. On the upper curve, there is first a positive voltage peak followed by a negative voltage peak, whereas on the lower curve, there is first a negative voltage peak followed by a positive voltage peak. It is this difference between the two signals transmitted which makes it possible to detect not only the passage of blade 5 through slot 2, but also the direction of rotation of disk 1. A means is thus provided of generating signals which can be processed and transmitted to a counter.

Figure 4:
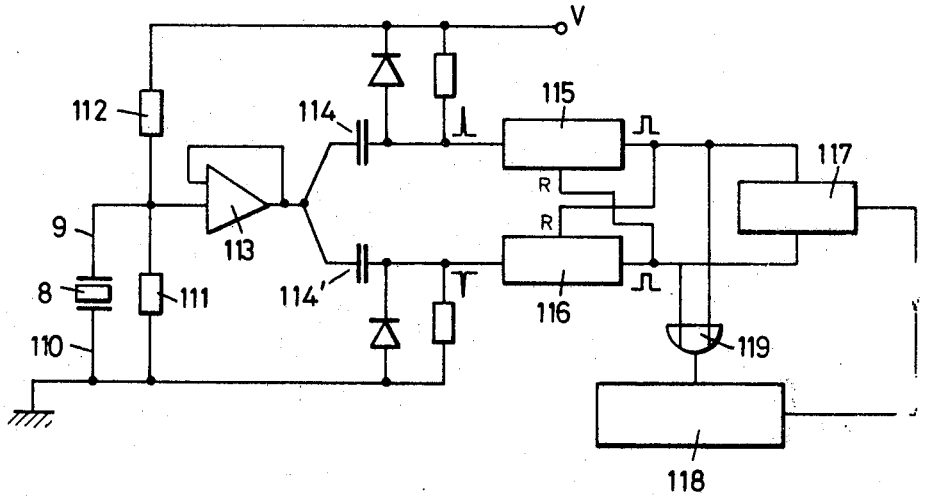
FIG. 4 is a diagram of the circuit for processing the detection signals.

FIG. 4 is a diagram showing how a detection and counting circuit suitable for carrying out these functions can be produced. Included in this diagram are quartz strip 8, wire 9, and a conductor 110 which connects the underside of strip 8 to the frame and symbolizes the fastening of quartz strip 8 to resilient blade 5. Wire 9 is connected to the mid-point between two resistors 111 and 112 placed in series between a voltage source V and the frame. This mid-point is connected to an input of an amplifier 113, the output of which includes an upper branch 114 and a lower branch 114'. The positive voltage peaks will be selected and shaped in a discriminator circuit 115, and the negative voltage peaks in a discriminator circuit 116. The outputs of circuits 115 and 116 yield calibrated rectangular pulses whenever a positive or negative voltage peak is registered. Circuits 115 and 116 may be flip-flops. Circuit 117 is a detector which determines whether the pulses coming from circuits 115 and 116 should be counted positively or negatively and which directs these pulses to a counter 118 having one input connected to detector 117 and another input connected via a gate 119 to the outputs of circuits 115 and 116. Counter 118 algebraically counts the pulses received and consequently ascertains the number of revolutions effected by disk 1 by counting positively when this disk rotates in one direction and negatively when it rotates in the other direction.

Thus, a device is provided that includes only one detecting element and simultaneously ascertains both the amplitude and the direction of rotation. Moreover, this detector includes no material contact. The braking torque it exerts on disk 1 is minimal since a very small bending stress suffices to produce a detectable voltage between the terminals of strip 8. Furthermore, the device obviates the difficulties and drawbacks associated with the use of electro-optical devices.

It will also be noted that the number of slots 2 at the periphery of disk 1 need not necessarily be limited to one. Always using a single detecting blade 5, a counter wheel having a number of regularly spaced slots 2 along its periphery may be provided, thus making it possible to ascertain the angle through which disk 1 has rotated with far greater precision than the 360° represented by the presence of a single slot 2. In particular, the use of a single detecting blade allows much finer angular detection than the use of several contacts or several photosensitive diodes disposed along the periphery of the disk.

The device described above may be used in a system for setting the watch, for example. If the watch is found to be slow, pulses must be supplied to the motor in order to cause it to rotate rapidly in the positive direction until the seconds-hand is on 60, for example. Conversely, if the watch is fast, it may be advantageous to turn the seconds-hand rapidly backward to the 60 position so that, in both cases, the watch stops with its seconds-hand in the starting position and can be restarted instantly simultaneously with the "beep" of a time signal. All that is needed for doing this is to have a motor capable of rotating in either direction as a function of the polarity of the pulses received by its coil and to control this rotation in one direction or the other according to the correction to be made. A detector such as that described above may also be used in a watch having an hour-hand that can change position by jumps of one hour, a half-hour, or a quarter of an hour in order to be adjusted to a new time zone. Still other functions may be performed by means of such a device as well.

What is claimed is:

1. An electronic watch, comprising:

a frame;

hands;

a gear train for driving said hands, comprising a disk-shaped counterwheel having position-indicating means, comprising a radial slot in said counterwheel, said slot having edges which form projecting elements;

a stepping motor for driving said gear train;

a detection circuit;

a counter;

movable detecting means comprising a resilient blade disposed radially from said counterwheel at a fixed location and a piezoelectric element secured to said blade, cooperating with said position-indicating means and connected to said detection circuit and to said counter, said detecting means being capable of causing the transmission of signals in said detection circuit upon rotation of said counter wheel, said projecting elements being adapted to move said detecting means differently depending upon the direction of rotation of said counterwheel, whereby said signals cause the algebraic counting of the number of revolutions effected by said counterwheel, said blade normally being kept bent by pressing against one or the other of the faces of said counterwheel, said slot being so arranged that when said slot is aligned with said blade, said blade straightens out, then either vibrates and again presses against the same face of said counterwheel or passes to the other face of said counterwheel without vibrating, according to the direction of rotation of said counterwheel.

2. The watch of claim 1, wherein said disk-shaped counterwheel is a thin disk having a circular periphery including a said slot of a width substantially equal to that of said blade, said edges being bent out of the plane of said disk in opposite directions.

3. The watch of claim 1, further comprising a circuit for processing said signals, wherein the end of said blade remote from said disk-shaped counterwheel is fixed to said frame, said piezoelectric element being mounted on said blade near said fixed end thereof, one face of said piezoelectric element being connected to said frame via said blade, and another face of said piezoelectric element being connected to said circuit for processing said signals.

* * * * *